United States Patent [19]

Furukawa

[11] Patent Number: 4,673,371

[45] Date of Patent: Jun. 16, 1987

[54] ROBOT-LIKE TOY VEHICLE

[75] Inventor: Masami Furukawa, Tokyo, Japan

[73] Assignee: Tomy Kogyo Co., Inc., Tokyo, Japan

[21] Appl. No.: 800,766

[22] Filed: Nov. 22, 1985

[30] Foreign Application Priority Data

Apr. 26, 1985 [JP] Japan ..... 60-62996[U]
Apr. 26, 1985 [JP] Japan ..... 60-62997[U]

[51] Int. Cl.[4] ..... A63H 30/00

[52] U.S. Cl. ..... 446/175; 446/290; 446/353

[58] Field of Search ..... 446/175, 352, 353, 354, 446/288, 289, 290, 291, 294, 279, 230, 238, 237, 269, 270

[56] References Cited

U.S. PATENT DOCUMENTS 2,269,334 1/1942 Bocchino ..... 446/355 X
3,512,300 5/1970 Thoresen ..... 446/289
4,085,542 4/1978 Mitamura ..... 446/175

FOREIGN PATENT DOCUMENTS 676936 8/1952 United Kingdom .
740586 11/1955 United Kingdom ..... 446/294
1032676 1/1964 United Kingdom .

OTHER PUBLICATIONS

U.K Search Report dated 1/31/86.

*Primary Examiner*—Mickey Yu
*Attorney, Agent, or Firm*—Staas & Halsey

[57] ABSTRACT

A robot-like toy vehicle is provided, including: a self-propelled base having a power source; a housing for reciprocally rotating relative to the base; a pair of arms mounted on opposite sides of the housing for swinging movement; a support attached to the base within the housing; a head mounted on the support for inclining and returning movement; an elevation member mounted for upward and downward movement along the support to incline and return the head; a rotary lever for raising and lowering the elevation member; and a cam for rotating the rotary lever. During operation, the housing of the toy vehicle rotates while the left and right arms swing so as to represent playful walking. In addition, the cam moves to rotate the rotary lever so as to raise and lower the elevation member and incline and return the head so as to represent the robot-like toy vehicle hanging or nodding its head. A microphone is mounted on the toy for sensing an external sound to change the movement of the toy via an electrical control circuit.

10 Claims, 7 Drawing Figures

ROBOT-LIKE TOY VEHICLE

BACKGROUND OF THE INVENTION

This invention relates to a toy vehicle and, more particularly, to a self-propelled toy vehicle in the shape of a robot which is propelled while performing predetermined tasks.

In the field of robot-like toy vehicles, there is an endless demand for novel performance. The present invention is directed to satisfying this demand.

SUMMARY OF THE INVENTION

The present invention is a robot-like toy vehicle including: a self-propelled base including a power source; a housing mounted for reciprocal rotation relative to the base; a pair of arms mounted on opposite sides of the housing for swinging movement; a support connected to the base; a head pivotally mounted on the support for inclining and returning movement; an elevation member mounted for upward and downward movement along the support to incline and return the head; a rotary lever for raising and lowering the elevation member; and a cam for rotating the rotary lever.

During operation, the robot-like toy vehicle is propelled forward with the housing rotating and the left and right arm members swinging, representing that the robot-like toy vehicle is playfully walking. In addition, the cam is moved to rotate the rotary lever, thus raising and lowering the elevation member. The upward and downward movement of the elevation member causes inclining and returning movement of the head, indicating that the robot-like toy vehicle is hanging or nodding its head.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Figure 1:
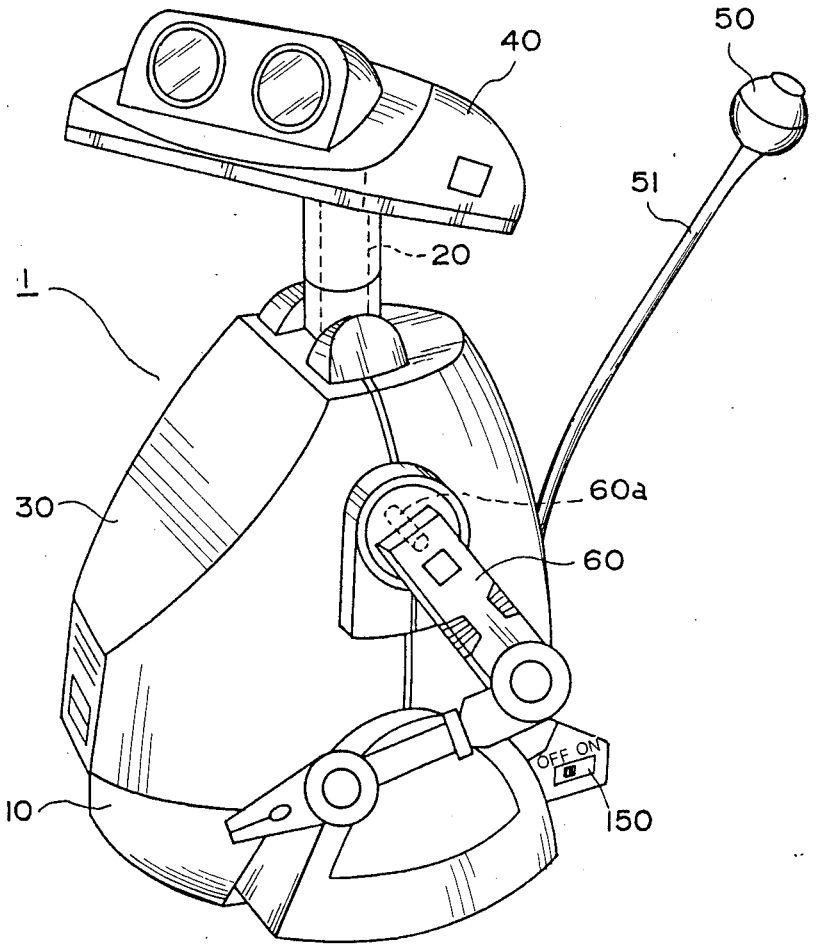
FIG. 1 is a perspective view of the robot-like toy vehicle of the present invention.

FIG. 1 is a perspective view showing a preferred embodiment of the robot-like toy vehicle 1 according to the present invention. The toy vehicle 1 includes: a base 10 having a direction changing castor 70 (FIG. 2), a power source 81 (FIG. 3) represented as a reversible motor 81*a* and a drive wheel 74 (FIG. 2) rotatable via power from the power source 81; a support 20 attached to the base 10 forming part of a neck; a head 40 pivotally mounted on the support 20 for inclining and returning movement; an elevation member 21 (FIGS. 2 and 6) also making up the neck mounted for upward and downward movement along the support 20 for inclining or returning the head 40; a cam 120 (FIGS. 2 and 4) operable via the power supplied from the power source 81 for raising and lowering the elevation member 21; a housing or trunk member 30 mounted on the base 10 for rotation about the support 20, the trunk member 30 being powered through a reverse mechanism 130 (FIG. 2) operable via the power source 81 for reciprocating rotation around the support 20; a pair of arm members 60 mounted on the left and right sides of the trunk member 30 for swinging movement; and a microphone 50 mounted on the upper end of a support beam 51 which is a resilient member mounted on the rear portion of the base 10.

When the external switch 150 is turned "on" to operate the power source 81 contained in the trunk member 30, the above-described robot-like toy vehicle 1 is propelled along a stationary support, such as a floor, and performs a first operation, wherein the trunk member 30 reciprocally rotates around the support 20 while the toy vehicle 1 is moving forward. The movement of the toy vehicle 1 causes the left and right arm members 60 to swing, representing that the toy vehicle 1 is moving playfully. When the microphone 50 senses a sound, the toy vehicle 1 performs a second operation wherein it stops moving, inclines its head 40 forward, and repeats the inclining motion of the head several times thereafter. This second operation represents the toy vehicle 1 hanging and nodding its head.

If, in the course of the toy vehicle 1 movement, it comes into contact with an obstacle (not shown) and is subject to a load exceeding a predetermined level, the direction changing castor 70 changes the direction of movement of the toy vehicle 1.

The various components of the robot-like toy vehicle 1 of the present invention introduced above will now be described in greater detail.

Although the base 10 may have any shape, in the embodiment shown in FIG. 1, it is a substantially cylindrical form with a bottom. The base 10 has legs 11 (FIG. 2) uniformly formed on opposite sides thereof. The shape of the legs 11 is not limited in any way to that illustrated. The direction changing castor 70 (FIG. 2) is mounted centrally on the front, lower portion of the base 10. A pair of follower wheels 12 is rotatably mounted at the rear, lower portion of the base 10.

The direction changing castor 70 has been used as a drive wheel 74 in conventional running toys of the type which automatically get around obstacles in the course of operation. When a running toy using such a drive wheel comes into contact with an obstacle and is subject to a force exceeding a predetermined level, the direction changing castor 70 changes direction so as to change the direction of movement of the toy vehicle 1.

The direction changing castor 70 includes: a U-shaped frame 71 rotatably mounted on a drive shaft 73; the drive wheel 74 mounted to the U-shaped frame 71 in an inclined position for clockwise movement, as viewed from the front; and a crown gear 74*a* mounted on one side of the drive wheel 74. A pinion 75, which is fixed to the drive shaft 73, meshes with the crown gear 74*a*.

In order to provide a return force for moving the change direction castor 70, a direction changing member 76 is provided having a sector rack 76*b* pivotally mounted via a shaft 76*a* which meshes with a pinion 72 placed on the upper surface of the U-shaped support frame 71. The sector rack 76*b* is biased via a spring 77.

Figure 2:
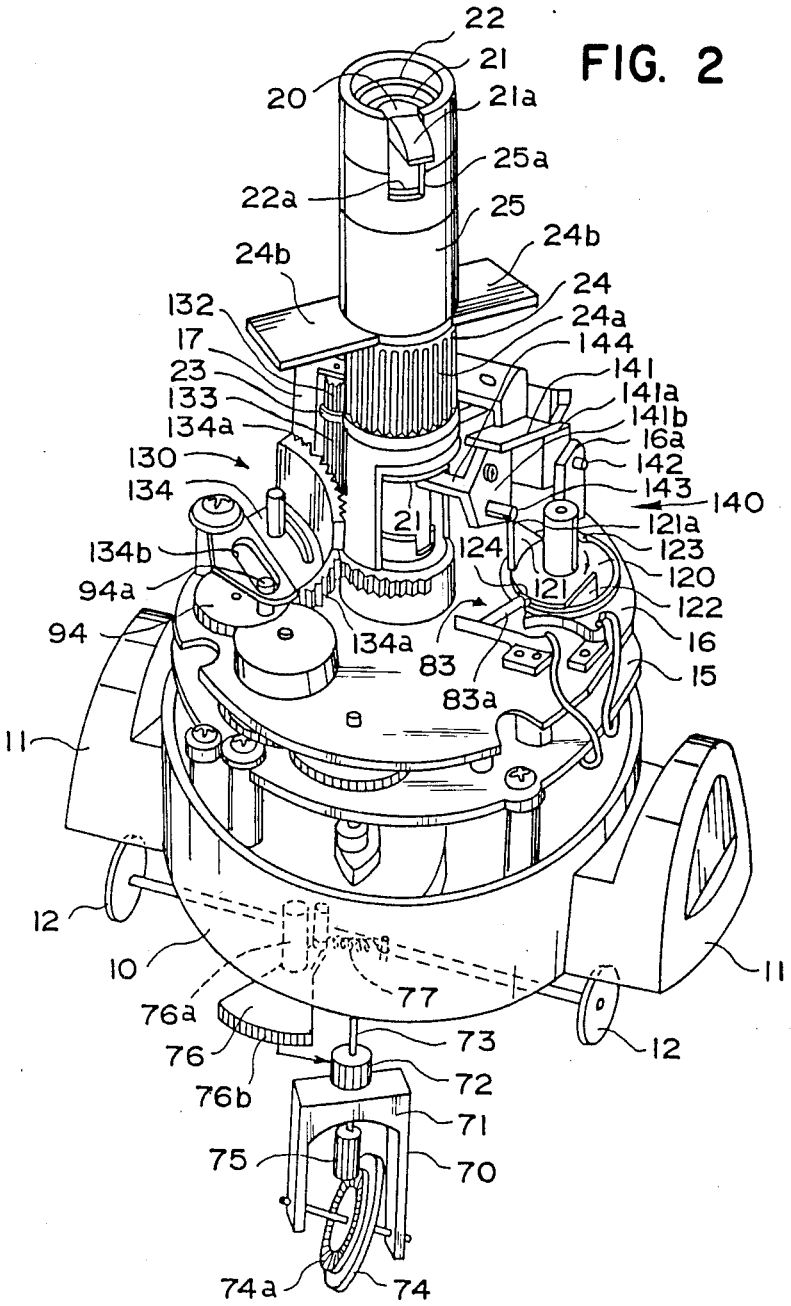
FIG. 2 is a perspective view showing the interior mechanism of the robot-like toy vehicle of the present invention.
Figure 3:
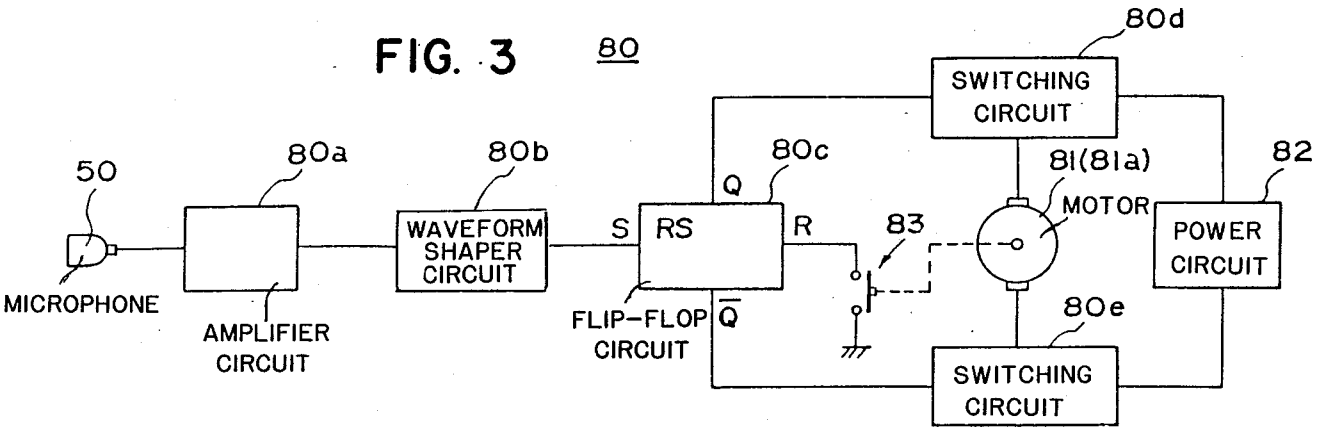
FIG. 3 is a diagrammatic view showing the electrical circuit employed in the present invention.
Figure 5:
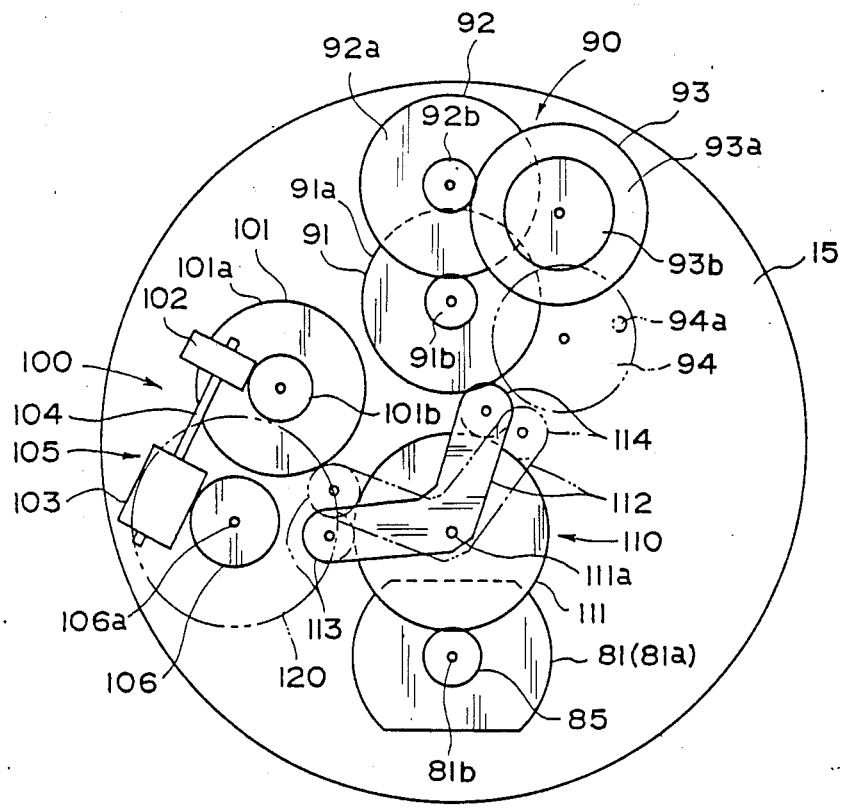
FIG. 5 is a top plan view showing a gear train of the present invention.

The base 10 supports first and second support plates 15 and 16 which are vertically separated a predetermined distance, as best shown in FIG. 2. The base 10 also supports, below the first support plate 15, the reversible motor 81*a* (FIG. 5). The motor 81*a* receives its supply of electric power from a switching circuit 80*d* from a power circuit 82 for rotating in a clockwise direction, as viewed from the front, and an electrical circuit 80 which includes circuit components 80*a* to 80*e* for reversing the direction of rotation of the motor 81*a* (into a counter-clockwise direction, as viewed from the front) when the microphone 50 senses a sound.

That is, the circuit components 80*a* to 80*e* include an amplifier circuit 80*a* for amplifying the audio signal fed from the microphone 50; a waveform shaper circuit 80*b* for converting the audio signal into a rectangular signal; and a flip-flop circuit 80*c* operable in response to the audio signal fed from the waveform shaper circuit 80*b* for reversing the direction of rotation of the motor 81*a* (into the counter-clockwise direction, as viewed from the front). An automatic switch 83, which is placed on the second support plate 16, is operated by the motor 81*a* to return the flip-flop circuit 80*c* to its initial condition, supplying electric power from the power circuit 82 through the switching circuit 80*d* to the motor 81*a* to rotate the motor 81*a* in the normal direction. The automatic switch 83 will be described later in greater detail.

FIG. 5 is a top plan view showing the first support plate 15 which supports thereon first and second transmission gear trains 90 and 100, respectively, for transmitting power from the motor 81*a* to the respective moving components, and a gear or power transmission switching mechanism 110 for switching the state of power transmission to the transmission gear trains 90 and 100.

That is, the first transmission gear train 90 includes a plurality of gears 91, 92 and 93, each including a large gear 91*a*, 92*a*, 93*a* and a small gear 91*b*, 92*b*, 93*b*, respectively. The small gear 91*b* meshes with the large gear 92*a* and the small gear 92*b* meshes with the large gear 93*a*.

The small gear 93*b* is thick and has an upper portion extending over the second support plate 16. This projecting small gear 93*b* meshes with a gear 94 pivoted on the second support plate 16. An eccentric pin 94*a* is set up at an eccentric position on the upper surface of the gear 94.

The second transmission gear train 100 includes: a gear 101 having a clockwise threaded worm gear 101*b* and a flat gear 101*a* formed as a unit with the worm gear 101*b*; a gear 105 having a gear 102 secured on a rotary shaft 104, the gear 102 being held in mesh engagement with the worm gear 101*b*; and a clockwise threaded worm gear 103 mounted on the lower side of the second support plate 16, a gear 106 being held in mesh engagement with the worm gear 103. A rotary shaft 106*a* on which the gear 106 is fixed, extends upwardly through the second support plate 16. The cam 120 is fixed on the upper end of the rotary shaft 106*a*.

The switching mechanism 110 includes: a gear 111 held in mesh engagement with a pinion 85 fixed on a drive shaft 81*b* of the motor 81*a*; an L-shaped lever 112 rotatably mounted on the upper end of a shaft 111*a* which rotatably supports the gear 111, the lever 112 being held in sliding contact with the upper surface of the gear 111; and planetary gears 113 and 114 rotatably mounted on the opposite ends of the lever 112, the planetary gears 113 and 114 being held in mesh engagement with the gear 111.

In the switching mechanism 110 arranged in such a manner, when the motor 81*a* rotates in the clockwise direction, as viewed in FIG. 5, thus rotating the gear 111 in the counter-clockwise direction, the lever 112 rotates in the counter-clockwise direction to bring the planetary gear 114 into mesh engagement with the large gear 91*a* of the gear 91, whereas the planetary gear 113 is free. In this case, rotational force is transmitted from the motor 81*a* to the gear 94 through the switching mechanism 110 and the first transmission gear train 90.

On the other hand, when the motor 81*a* rotates in the counter-clockwise direction as viewed in FIG. 5, the gear 111 rotates in the clockwise direction, causing rotation of the lever 112 in the clockwise direction to bring the planetary gear 113 into mesh engagement with the gear 101*a* of the gear 101; the planetary gear 114 is free. In this case, the rotational force of the motor 81*a* is transmitted through the switching mechanism 110 and the second transmission gear train 100 to the rotary shaft 106*a*, thus rotating the cam 120 fixed on the rotary shaft 106*a* in the clockwise direction.

Figure 6:
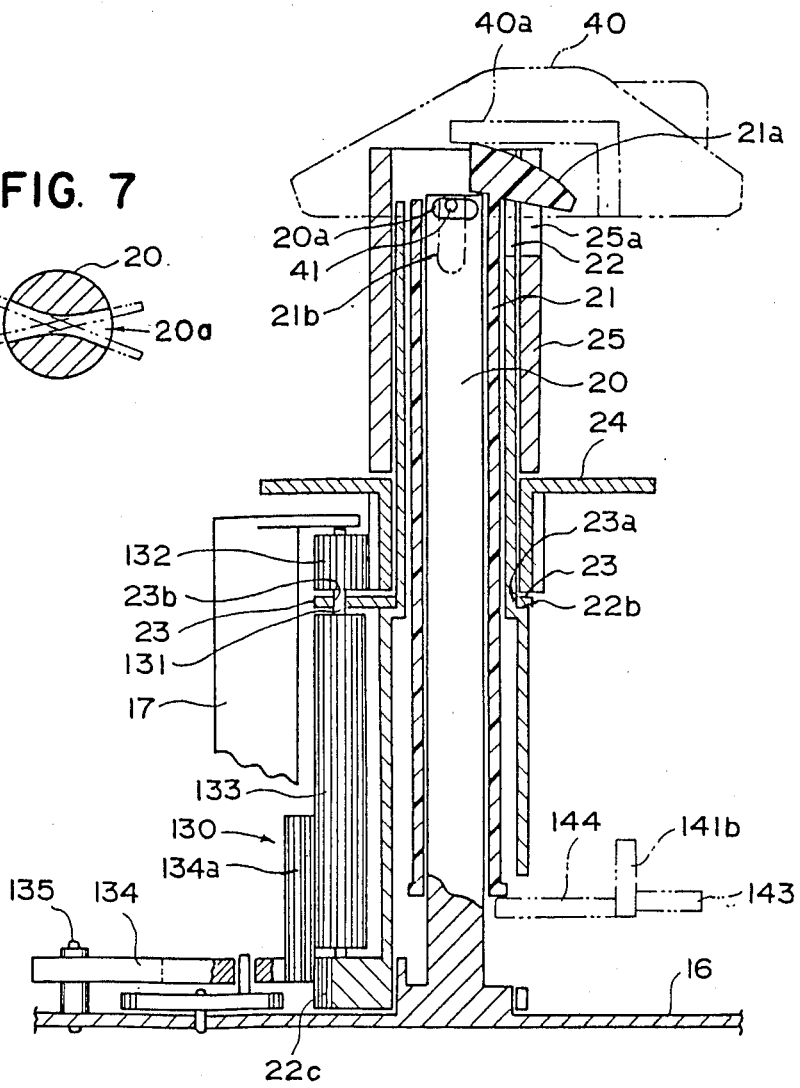
FIG. 6 is a side, cross-sectional view showing a support and an elevation member according to the present invention.

The support 20 is arranged on the support plate 16 (FIG. 6). The head 40 is mounted by a pin 41 on the upper end of the support 20 for inclining and returning movement (returning to the horizontal position). The elevation member 21, which is in the form of an elevation cylinder, is provided around the support 20 for rotation and upward and downward movement therealong. Although the elevation member 21 is shown as a cylindrical member in this embodiment, it is to be noted that it may not be cylindrical if its function is limited to an elevating function, not including a rotating function. A head support piece 21*a* is integrally formed with the upper end of the elevation member 21. The head support piece 21*a* has a curved smooth surface on its upper side. The front portion of the head 40 is supported on the head support piece 21*a* with the lower surface of the horizontal portion of an L-shaped piece 40*a* formed as a unit with the inner, front portion of the head 40 being in contact with the curved surface.

A rotary lever or member 141 is disposed near the support 20. As shown in FIG. 2, the rotary member 141 has a base 141*a* rotatably supported by a pin 142 on a pair of bearings 16*a* (only one of which is illustrated) arranged on the second support 16, so that a free end 141*b* can move upward and downward. A pin 143 and a support piece 144 are provided on the opposite sides of the free end 141*b* of the rotary member 141. A portion of the lower end of the elevation member 21 is placed on the support piece 144.

When the cam 120 rotates the rotary member 141 in the manner described hereinafter, the elevation member 21 moves up and down so as to incline and return the head 40.

A first swinging cylinder 22 is rotatably mounted around the elevation member 21. A gear 22*c* (FIG. 6) is formed at the lower end of the first swinging cylinder 22. The gear 22*c* is held in mesh engagement with a sector gear 134 to be described later within a predetermined angular range. The first swinging cylinder 22 includes at the front portion of its upper end a recess 22*a* for insertion of the head support piece 21*a*. A retainer cylinder 25, positioned above the second swinging cylinder 24 also includes a recess 25*a*. The first swinging cylinder 22 has a stepped portion 22*b* at its intermediate portion to form an upper large diameter portion and a lower small diameter portion. An insulating plate 23 has a circular, open end 23*a* placed on the stepped portion 22*b* of the first swinging cylinder 22.

A second swinging cylinder 24, which is mounted around the small diameter portion of the first swinging cylinder 22, is placed on the insulating plate 23. The insulating plate 23 serves to insulate the second swinging cylinder 24 from the first swinging cylinder 22 such that the rotation of one is independent of rotation of the other.

The second swinging cylinder 24 has a threaded portion 24*a* around the outer peripheral surface and a pair of trunk attachment pieces 24*b* on the upper end thereof. The frame-shaped trunk 30 (FIG. 1) is fixed to the trunk attachment pieces 24*b*.

Pin holes 20*a* and 21*b*, only two of which are shown, are formed in each of the support 20 and the components 21, 22 and 25. The pin 41 is inserted through the pin holes 20*a* and 21*b*. The head 40 is supported on the left and right ends of the pin 41 for inclining and returning movement as described hereinbefore.

Figure 7:
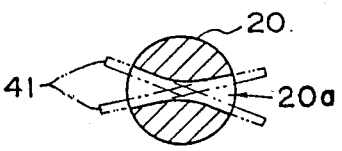
FIG. 7 is a top, cross-sectional view showing a pin hole formed in the support.

As shown in FIG. 7, which is a cross-sectional view, the pin hole 20*a* of the support 20 is formed such that the pin 41 placed in the pin hole 20*a* can rotate in a horizontal plane within a predetermined angular range. As indicated by the dotted line in FIG. 6, the pin hole 21*b* of the elevation member 21 is formed as a longitudinally elongated slit opening at its upper end in order to prevent the pin 41 from obstructing upward and downward movement of the elevation member 21. Other pin holes (not shown) formed in the first swinging cylinder 22 and the retainer cylinder 25 are formed as circular holes having a diameter substantially the same as that of the pin 41 for free rotation of the pin 41.

Provided near the first swinging cylinder 22 are components which constitute the reversal mechanism 130 for reciprocally rotating the first swinging cylinder 22 and the second swinging cylinder 24.

That is, a rotary shaft 131 is supported by the combination of an axial hole (not shown) formed in the second support plate 16 and an axial hole (not shown) formed in a bearing member 17 arranged on the second support plate 16. A short pinion 132 and a long pinion 133 are fixed on the upper and lower portions of a rotary shaft 131, respectively. The short pinion 132 meshes with the threaded portion 24*a* of the second swinging cylinder 24. The long pinion 133 meshes with the threaded portion 134, which meshes with the gear 22*c* of the first swinging cylinder 22. The rotary shaft 131 has a portion intermediate of the short and long pinions 132 and 133 which is loosely fitted in an axial hole 23*b* formed in a projecting portion of the insulating plate 23. The sector gear 134 is placed at the periphery of the second support plate 16 with its base portion rotatably supported by a shaft 135. A threaded portion 134*a* meshes with the long pinion 133 and the gear 22*c*. The sector gear 134 is formed with an elongated hole 134*b* extending radially thereof (FIG. 2). The eccentric pin 94*a*, arranged on the gear 94, is received by the elongated hole 134*b*.

In the robot-like toy vehicle 1 arranged as described above, the sector gear 134 rotates reciprocally upon rotation of the gear 94, thus reciprocally rotating the trunk member 30 through the pinions 133 and 132 and the second swinging cylinder 24, while at the same time reciprocally rotating the head 40 to the left and right through the first swinging cylinder 22. In this case, the direction of rotation of the trunk member 30 is opposite to that of the head 40, since the force is transmitted to the swinging cylinder 24 through the pinions 133 and 132.

Since the arm members 60 are mounted rotatably through pins 60*a* arranged on the left and right sides of the trunk member 30, the left and right arm members 60 swing in the opposite directions upon reciprocal rotation of the trunk member 30. This swinging arm motion is similar to the swinging motion of a person's arms when walking.

Figure 4:
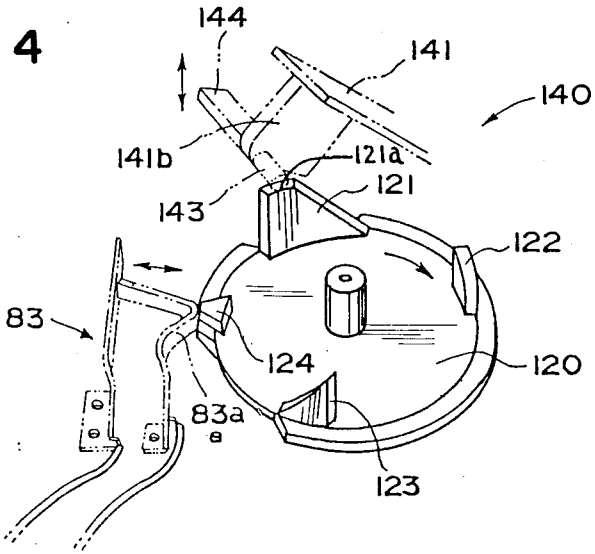
FIG. 4 is a perspective view showing the relationship between an elevation mechanism and an automatic switch of the present invention.

On the other hand, the elevation mechanism 140 which moves the elevation member 21 upward and downward and the rotary member 141 rotated by the cam 120 are placed on the second support plate 16 near the first swinging cylinder 22, as shown in FIGS. 2 and 4.

The cam 120 has a disc shape whose upper surface near the outer periphery includes three cam projections 121, 122 and 123 positioned substantially in a right-angle triangular disposition. The cam projection 121 is formed on its upper end with a flat portion 121*a*.

Since the elevation mechanism 140 is arranged as described above, each cam projection 121, 122 and 123 comes sequentially into contact with the pin 143 formed at the free end 141*b* of the rotary member 141 to push the free end 141*b* upward when the cam 120 rotates in the clockwise direction, as viewed from above in FIG. 4. When the free end 141*b* of the rotary member 141 is pushed upward, the elevation member 21 is pushed upward by the projection 144, on the other side from the pin 143 on the rotary member 141.

The cam projections 121, 122 and 123 have different heights. When the pin 143 of the rotary member 141 is on the flat portion 121*a* of the highest cam projection 121, the front portion of the head 40 is pushed downward through the elevation member 21 so as to bring the head 40 substantially to a horizontal position. When the pin 143 is on the flat portion of the cam 120 between the cam projections 121, 122 and 123, the front portion of the head 40 moves downward together with the elevation member 21 so as to bring the head to a downwardly inclined position.

The cam 120 has another cam projection 124 formed on the outer peripheral portion thereof for operating the automatic switch 83. The cam projection 124 abuts the movable contact 83*a* of the switch 83 when the flat portion 121*a* of the cam projection 121 abuts the pin 143 of the rotary member 141 to push the pin 143 upward.

When the automatic switch 83 changes to the closed state, the flip-flop circuit 80*c* allows current to flow from the switching circuit 80*d* to the motor 81*a* so as to rotate the motor 81*a* in the normal direction (in the clockwise direction as viewed in FIG. 5). The power is transmitted from the motor 81*a* through the power transmission switching mechanism 110, the first transmission gear train 90 and the reversal mechanism 130 to run the robot-like vehicle 1 with the trunk member 30 and the head 40 rotating in opposite directions. In this case, the left and right arm members 60 swing in the manner described above upon the reciprocal rotation of the trunk member 30.

If a sound having a level exceeding a predetermined value, such as when a person clapping his hands or calling out, is sensed through the microphone 50 in the course of operation of the toy vehicle 1, the flip-flop circuit 80*c* reverses its state to permit current to flow from a switching circuit 80*e* to the motor 81*a*, causing the motor 81*a* to rotate in the reverse direction (in the counter-clockwise direction).

When the motor 81*a* reverses its rotational direction, the power is transmitted from the motor 81*a* through the reversal mechanism 130 and the second transmission gear train 100 to the cam 120, causing the cam 120 to rotate in the clockwise direction as viewed from above (in the direction indicated by the arrow of FIGS. 2 and 4). The rotation of the cam 120 in this direction causes the pin 143 of the rotary member 141 to fall from the cam projection 121 to lower the free end 141*b* so as to move the front portion of the head 40 downward. At the same time, the movable contact 83*a* is released from the cam 124 to open the automatic switch 83 so as to continue the rotation of the motor 81*a* in the reverse direction.

When the pin 143 of the rotary member 141 falls from the cam projection 121 during one rotation of the cam projection 121, the cam projections 122 and 123 return the inclined head 40 substantially to its horizontal position twice. The inclining and returning operation of the head 40 represents the robot-like toy vehicle 1 hanging his head and nodding it twice.

When the pin 143 of the rotary member 141 rides on the cam projection 121 again, the head 40 returns substantially to its horizontal position and, at the same time, the cam 124 abuts the movable contact 83*a* so as to close the automatic switch 83 again. This causes the flip-flop circuit 80*c* to change to its initial state. In this state, the flip-flop circuit 80*c* permits current flow from the power source 81 through the switching circuit 80*d* to the motor 81*a*, returning the direction of rotation of the motor 81*a* to its initial direction. At this time, the cam 120 stops.

In summary, the robot-like toy vehicle 1 of the present invention includes a trunk member deriving a supply of power via a reversal mechanism from a power source for reciprocally rotating, and arm members rotatably supported by the trunk member. During operation of the toy vehicle 1, the trunk member reciprocally rotates with the arm members swinging. This movement provides a new and interesting performance representing the toy walking with his trunk and arms swinging. In addition, the head 40 is inclined and returned via the power source 81. The movement of the head also provides an interesting performance, representing the robot-like toy vehicle 1 hanging and nodding its head.

The foregoing is considered illustrative only of the principles of the invention. Further, since numerous modifications and changes will readily occur to those skilled in the art, it is not desired to limit the invention to the exact construction and operation shown and described.

Accordingly, all suitable modifications and equivalents may be resorted to, falling within the scope of the invention and the appended claims and their equivalents.

What is claimed is:

1. A robot-like toy vehicle, comprising:

(a) a power source;

(b) a base;

(c) first means connected between the base and the power source for propelling the base;

(d) a housing rotatably mounted on the base;

(e) second means operatively connected between the power source and the housing for rotating the housing relative to the base;

(f) a support attached to the base within the housing;

(g) a first member movably mounted for up and down movement along the support;

(h) a second member pivotally mounted to the support for inclining and returning movement relative thereto;

(i) third means operatively connected between the power source and the first and second members for moving the first and second members; and (j) fourth means for controlling operation of the power source.

2. The toy vehicle as recited in claim 1, wherein the power source comprises: an electric, reversible motor.

3. The toy vehicle as recited in claim 1, wherein the first means comprises: a driven wheel operatively connected to the reversible motor via a first gear train and a pair of follower wheels.

4. The toy vehicle as recited in claim 3, wherein the second means comprises a swinging cylinder connected between the housing and the motor via a second gear train.

5. The toy vehicle as recited in claim 4, wherein the third means comprises:

(i) a cam operatively connected to the motor, and (ii) a rotary lever operatively connected between the first member and the cam, wherein movement of the cam rotates the rotary lever and raises and lowers the first member, thus moving the second member.

6. The toy vehicle as recited in claim 5, wherein the fourth means comprises a manual switch and a microphone electrically connected via a circuit between the base and the motor.

7. The toy vehicle as recited in claim 1, wherein the housing comprises:

a pair of oppositely disposed arms mounted for swinging movement.

8. The toy vehicle as recited in claim 7, wherein the first member and support form a neck and the second member forms a head.

9. The toy vehicle as recited in claim 8, wherein the base, housing, neck, head and arms are configured to represent a robot having a humanoid shape.

10. A robot-like vehicle, comprising:

(a) an electric, reversible motor;

(b) a base;

(c) a drive wheel connected to the motor via a gear train and a pair of follower wheels for propelling the base;

(d) a housing rotatably mounted on the base including arms mounted for rotation relative to the housing;

(e) a swinging cylinder fixedly connected to the housing and operatively connected to the motor via a gear train for rotating the housing relative to the base;

(f) a support member mounted to the base;

(g) a head mounted to the support member for inclining and returning movement relative thereto;

(h) an elevation member mounted for up and down movement along the support;

(i) a cam operatively connected to the motor;

(j) a rotary lever operatively connected between the elevation member and the cam; and (k) a manual switch and a microphone electrically connected to the motor via a circuit for controlling the motor, wherein movement of the manual switch activates the motor, causes the drive wheel and follower wheels to propel the base, rotates the housing relative to the base, swings the arms, elevates the elevation member and inclines and returns the head, and wherein audible activation of the micrphone causes the motor to stop movement and reactivates the elevation member to elevate and incline and return the head.

* * * * *